US006205291B1

(12) United States Patent
Hughes et al.

(10) Patent No.: US 6,205,291 B1
(45) Date of Patent: Mar. 20, 2001

(54) SCALE-INHIBITING HEATING ELEMENT AND METHOD OF MAKING SAME

(75) Inventors: Dennis R. Hughes, Hartford; Ray O. Knoeppel, Hartland, both of WI (US)

(73) Assignee: A. O. Smith Corporation, Milwaukee, WI (US)

( * ) Notice: Subject to any disclaimer, the term of this patent is extended or adjusted under 35 U.S.C. 154(b) by 0 days.

(21) Appl. No.: 09/382,908

(22) Filed: Aug. 25, 1999

(51) Int. Cl.[7] ..... F24H 1/20
(52) U.S. Cl. ..... 392/457; 392/489; 392/503
(58) Field of Search ..... 392/441, 449, 392/451, 452, 453, 454, 455, 456, 457, 478, 485, 488, 489, 497, 503; 204/196.37; 428/408

(56) References Cited

U.S. PATENT DOCUMENTS

| | | | | |
|---|---|---|---|---|
| 4,036,716 | * | 7/1977 | Hulthe | 204/196.37 |
| 4,169,028 | * | 9/1979 | Yokoyama et al. | 204/196.37 |
| 4,379,220 | * | 4/1983 | Middleman et al. | 392/497 |
| 4,563,571 | * | 1/1986 | Koga et al. | 392/497 |
| 4,770,940 | * | 9/1988 | Ovshinsky et al. | 428/408 |
| 4,809,876 | * | 3/1989 | Tomaswick et al. | 428/408 |
| 4,848,616 | | 7/1989 | Nozaki | 219/322 |
| 4,849,160 | | 7/1989 | Hertz | 376/416 |
| 4,982,068 | * | 1/1991 | Pollock et al. | 392/488 |
| 5,022,459 | * | 6/1991 | Chiles et al. | 392/478 |
| 5,433,995 | * | 7/1995 | Matthews et al. | 428/408 |
| 5,458,927 | | 10/1995 | Malaczynski et al. | 427/527 |
| 5,461,648 | | 10/1995 | Nauflett et al. | 376/305 |
| 5,529,815 | | 6/1996 | Lemelson | 427/575 |
| 5,586,214 | | 12/1996 | Eckman | 392/503 |
| 5,728,465 | | 3/1998 | Dorfman et al. | 428/408 |
| 5,774,627 | * | 6/1998 | Jackson | 392/497 |
| 5,878,192 | | 3/1999 | Jackson | 392/452 |
| 5,930,459 | | 7/1999 | Eckman et al. | 392/503 |
| 5,943,475 | * | 8/1999 | Jackson | 392/497 |
| 6,071,597 | * | 6/2000 | Yang et al. | 428/408 |

FOREIGN PATENT DOCUMENTS 60-200044 * 9/1985 (JP) .

OTHER PUBLICATIONS

Spear, K. E. and J. P. Dismokes, "Synthetic Diamond: Emerging CVD Science & Technology", pp. 123–125, John Wiley, N.Y. (1994).

Chen, J., J. R. Conrad and R. A. Dodd, "Structure and Properties of Amorphous Diamond–Like Carbon Films Produced by Ion Beam Assisted Plasma Deposition", *Journal of Materials Engineering & Performance* vol. 2 (6), pp. 839–842 (Dec. 1993).

*Appliance*, Article Regarding Confortechnologies (1 page).

"Flow Through Heaters Keep Clean", *Appliance Engineering/Design* (July 1993) (1 page).

* cited by examiner

*Primary Examiner*—Teresa Walberg
*Assistant Examiner*—Fadi H. Dahbour
(74) *Attorney, Agent, or Firm*—Michael Best & Friedrich LLP

(57) ABSTRACT

A scale-inhibiting water heater element is provided. The water heater element is coated with a diamond-like coating which has low surface tension to keep scale from forming, and is thermally conductive, which helps prevent overheating. The scale-inhibiting water heater element may be manufactured, for example, by coating a standard water heater element with an amorphous silicon adhesion layer, and then applying a diamond-like coating using a pulsed-glow discharge process.

22 Claims, No Drawings

SCALE-INHIBITING HEATING ELEMENT AND METHOD OF MAKING SAME

STATEMENT REGARDING FEDERALLY SPONSORED RESEARCH OR DEVELOPMENT

This invention was made with United States Government support under Award No. 70NANB5H1146 awarded by the U.S. Department of Commerce, National Institute of Standards and Technology. The United States Government has certain rights in the intention.

FIELD OF THE INVENTION

The present invention relates to heating elements, and in particular to heating elements utilized within water heaters.

BACKGROUND OF THE INVENTION

Conventional electric water heaters have elongated heating elements comprising an outer tubular sheath enclosing an inner electrical resistance wire. In a typical element, the internal metallic resistance wire is surrounded by a material such as magnesium oxide which is an electrical insulator but is capable of a reasonably high heat transfer rate. The outer sheath may be formed of a metal such as copper or an INCOLOY material. Thermal energy passes from the hot resistance wire through the insulating material and sheath wall to the sheath surface, thereby heating the water.

Over time electric water heater elements tend to develop scale or calcium carbonate, which is a poor heat conductor. The heating element has a high heat flux so the poor thermal conductivity of the scale film tends to cause the heating element to overheat, which can lead to failure of the heating element. Also, the growth of scale on the element may physically deform the element and cause failure. Finally, as scale grows thick it tends to flake off from the element and into the heated water.

Various solutions have been proposed to alleviate the problems created by scaling of heating elements. For example, U.S. Pat. No. 5,586,214 to Eckman shows a water heater heating element which is alleged to minimize lime depositing. The Eckman heating element replaces the customary metallic sheath of the heating element with a plastic sheath. Attempts to coat heating elements with unconventional materials are usually unsuccessful due to adhesion problems or overheating.

In another proposed solution, the watt density is reduced so that scale will form at a lower rate, thus extending the element life. This may be accomplished by using a resistance wire of lower wattage rating, or increasing the sheath diameter and/or length. The disadvantages of this method are that an element of greater surface area is required, causing difficulties and fitting the element into smaller heater tanks, or increasing the cost through enlarged element size and enlarged port and mount size.

A scale-inhibiting water heater element suitable for use in conventional water heaters would be desirable.

SUMMARY OF THE INVENTION

The present invention provides a scale-inhibiting heating element and a method of making the same. The heating element is coated with a diamond-like coating which has a low surface tension and prevents scale from forming on the heating element. The diamond-like coating is also thermally conductive; in other words, the coating permits heat to flow out away from the heating element and into the water. In addition to inhibiting scale formation, the coating has also been found to be electrically resistive which is desirable because it decreases the drain on the anode caused by the presence of a metal heating element in contact with the water.

Although diamond-like coatings (DLCs) are known, these coatings are typically used for corrosion resistance to protect the substrate to which they are applied (see, for example, U.S. Pat. No. 5,728,465 to Dorfman, and U.S. Pat. No. 5,529,815 to Lemelson), or for wear resistance (see, for example, U.S. Pat. No. 5,458,927 to Malaczynski). Heating elements, for example, in water heaters, are not subject to wear during use, and are not typically subject to corrosion because customary heating element materials are corrosion resistant metals such as an INCOLOY or copper material. Therefore, the use of diamond-like coatings on heating elements to inhibit scale formation is unique. Diamond-like coatings have been found to provide low surface tension and thermal conductivity sufficient to provide suitable scale-inhibiting properties to heating elements without overheating the element.

To inhibit scale formation, a diamond-like coating may be applied to other surfaces in contact with unpurified, heated water, such as heat exchangers, bottoms heads and flues of gas water heaters and internal sides of water heaters. Other proposed applications include heating elements for coffee pots and tea kettles, valve assemblies and hot water fixtures.

One embodiment of the present invention is a scale-inhibiting heating element comprising a heating element, and a diamond-like coating at least partially coating the surface of the heating element. The invention also provides a water heater comprising a tank for containing water and a heating element as described above.

Another aspect of the invention is a method of manufacturing the scale-inhibiting heating element. The method involves applying a diamond-like coating to the surface of the heating element.

Yet another aspect of the invention is a method of inhibiting scale formation on the surface of a heating element by applying a diamond-like coating to the surface of the heating element. Preferably, an interfacial layer or an adhesion layer is applied prior to applying the diamond-like coating.

Other features and advantages of the invention will become apparent to those skilled in the art upon review of the following detailed description in claims.

Before one embodiment of the invention is explained in detail, it is to be understood that the invention is not limited in its application to the details of construction, or to the steps or acts set forth in the following description. The invention is capable of other embodiments and of being practiced or being carried out in various ways. Also, it is understood that the phraseology and terminology used herein is for the purpose of description and should not be regarded as limiting.

DETAILED DESCRIPTION OF THE PREFERRED EMBODIMENTS

In a preferred embodiment, the present invention is a scale-inhibiting water heater element which comprises a conventional water heater element, and interfacial layer disposed on the surface of the water heater element, and a diamond-like coating disposed on the interfacial layer. Preferably, the interfacial layer comprises an amorphous silicon. The resulting heating element may be placed in a water heater. A typical water heater has a tank for containing water, and a heating element within the tank. In normal operation, the scale-inhibiting heating element will be immersed in a fluid medium such that the fluid medium comes in direct contact with the diamond-like coating. The fluid medium is typically water that contains impurities.

In a highly preferred embodiment, the present invention provides a method of inhibiting scale formation on a surface of a water heater heating element by applying a diamond-like coating to the surface of the heating element. More specifically, a water heater element is provided which comprises an electrical wire, an electrically insulating layer surrounding the electrical wire, and a corrosion-resistant metal sheath surrounding the electrically insulating layer. An amorphous silicon interfacial layer is disposed on the surface of the heating element. Then, the diamond-like coating is applied.

Another aspect of the invention is a method of minimizing galvanic corrosion of a metal in contact with water which contains an electric heating element immersed therein. When the two dissimilar metals are in contact with water, galvanic current flow between the metals tends to cause galvanic corrosion of at least one of the metal surfaces. For example, when a metal water heater element is immersed in a metal water heater tank, galvanic current tends to corrode the less corrosion resistant metal. If a sacrificial anode is placed in the tank, the anode corrodes. For further discussion of galvanic corrosion and electrical heating elements, see U.S. Pat. No. 4,848,616 which is herein fully incorporated by reference. The method of the invention comprises applying a diamond-like coating to the surface of the heating element. Employing a DLC-coated heating element provides a method of minimizing galvanic corrosion. The DLC is electrically resistive (or electrically insulating) and insulates the heating element from other metals in contact with the water. Therefore, the DLC coating reduces galvanic current flow between the metals, which in turn minimizes galvanic corrosion.

To practice the invention, the shape and size of the heating element is not critical, and conventional heating elements may be employed such as those well-known in the art. See, for example, FIGS. 1 and 2 of U.S. Pat. No. 5,878,129 to Jackson, which is herein fully incorporated by reference. Customary heating elements include an electrical wire, an electrically insulating layer surrounding the electrical wire, and a sheath surrounding the electrically insulating layer. Thus, the outer surface of the sheath is the surface of the heating element. The sheath is usually a corrosion-resistant metal. Preferably, the heating element is a water heater element.

Turning to the diamond-like coating, these coatings are carbon based films which may be produced by a variety of ion beam and plasma techniques such as low energy carbon ion beam, dual beam, ion plating techniques, and rf sputtering, or rf and dc plasma deposition of a hydrocarbon gas (such as acetylene) or other alkanes. For a more detailed discussion of diamond-like coatings and methods of their application, see, for example, U.S. Pat. No. 5,458,927 to Malczynski, U.S. Pat. No. 5,529,815 to Lemelson, and U.S. Pat. No. 5,728,465 to Dorfman, which are herein fully incorporated by reference. The diamond-like coating is preferably applied using an ion beam assisted deposition (IBAD) process, or a pulsed-glow discharge process like that described in J. Chen et al., "Structure and Properties of Amorphous Diamond-Like Carbon Films Produced by Ion Beam Assisted Plasma Deposition", *Journal of Materials, Engineering and Performance*, Volume 2(6), pages 839–842 (December 1993), which is herein fully incorporated by reference. The DLC is desirably applied in a thickness sufficient to prevent or inhibit scale-formation (preferably, at least enough to completely cover the portion of the element to be exposed to water; more preferably, at least about 25 nanometers thick). The DLC should not be so thick, however, that it spalls off; preferably, the DLC is less than about 10 microns thick.

An interfacial layer disposed between the DLC and the surface of the heating element is desirable to enhance adhesion of the diamond layer to the heating element. Therefore, preferably, the interfacial layer is applied in a thickness sufficient to provide the desired adhesion. The interfacial layer thickness is preferably greater than about 2 nanometers; more preferably, greater than about 25 nanometers. If the interfacial layer is too thick, however, thermal conductivity may be inhibited causing the element to overheat, or stresses may become too high causing the coating to spall off. The interfacial layer is preferably less than about 700 nanometers thick. The interfacial layer or adhesion layer may include any composition which adheres to both the heating element surface material and the DLC. An amorphous silicon interfacial layer is preferred. Amorphous silicon is known to be prepared, for example, using gaseous silane ($SiH_4$) and optional doping agents in a glow discharge tube at low pressure.

The scale-inhibiting heating element is preferably prepared by first cleaning the element to remove oxides or scale which could inhibit adhesion of the DLC. The element may be cleaned by any conventional method, such as grit blasting, or sputter cleaning, for example, using argon gas. After cleaning, an adhesion layer and the DLC may be applied.

EXAMPLES

A scale-inhibiting water heater element may be prepared as follows.

A customary water heater element having an INCOLOY sheath 0.375" (0.95 cm) in diameter is sputter cleansed using argon gas as follows:

| Example | m Torr Argon | Pulse Bias | Pulse Width | Pulse Frequency | Clean to Dose Range of: |
|---|---|---|---|---|---|
| 1 | 35 | 2 kV | 10 $\mu$S | 20 kHz | $1–5 \times 10^{17}$ cm$^{-2}$ |
| 2 | 15 | 2 kV | 20 $\mu$S | 10 kHz | $4 \times 10^{16}$ cm$^{-2}$ |

An amorphous silicon interfacial layer is applied using silane gas in a pulsed-glow discharge plasma generation process and the following process parameters:

| Example | m Torr Silane | Pulse Bias | Pulse Width | Pulse Frequency | Total Duration | Silane Coating Thickness |
|---|---|---|---|---|---|---|
| 1 | 5–8 | 4 kV | 50 $\mu$S | 4 kHz | ~30 min. | 50 nanometers |
| 2 | 15 | 4 kV | 20 $\mu$S | 10 kHz | ~1 hour | ~500 nanometers |

A DLC is then applied using a pulsed-glow discharge plasma generation process and the following process parameters:

| Example | m Torr Acetylene ($C_2H_2$) | Pulse Bias | Pulse Width | Pulse Frequency | Total Duration | DLC Thickness |
|---|---|---|---|---|---|---|
| 1 | 13 | 4 kV | 30 $\mu$S | 4 kHz | ~3.5 hours | 4.5 micron |
| 2 | 10 | 4 kV | 30 $\mu$S | 4 kHz | ~4.5 hours | 2.9 micron |

The diamond-like coating composition of Example 2 is estimated to be approximately 70% carbon and 30% hydrogen; the resulting coating has a hardness of 13.5 GPa and a modulus of 135 GPa.

The resulting coated water heater elements are then placed in conventional water heaters. The coated elements resist scale formation.

Various features of the invention are set forth in the following claims.

What is claimed is:

1. A method of inhibiting scale formation on a surface of a heating element, the method comprising applying a diamond-like coating to the surface of the heating element.

2. The method of claim 1 wherein an interfacial layer is applied to the surface of the heating element prior to applying the diamond-like coating.

3. The method of claim 2 wherein the interfacial layer comprises an amorphous silicon.

4. The method of claim 1 wherein the method further comprises immersing the coated heating element into a fluid medium such that the fluid medium comes in direct contact with the diamond-like coating.

5. The method of claim 1 wherein the heating element is placed in a water heater.

6. The method of claim 1 wherein:

the heating element is a water heater element comprising an electrical wire, an electrically insulating layer surrounding the electrical wire, and a corrosion-resistant metal sheath surrounding the electrically insulating layer; and an amorphous silicon interfacial layer is disposed between the surface of the heating element and the diamond-like coating.

7. A scale-inhibiting heating element comprising:

a heating element having an exterior surface; and a diamond-like coating at least partially coating the surface of the heating element.

8. The scale-inhibiting heating element of claim 7 wherein an interfacial layer is disposed between the surface of the heating element and the diamond-like coating.

9. The scale-inhibiting heating element of claim 8 wherein the interfacial layer comprises an amorphous silicon.

10. The scale-inhibiting heating element of claim 7 wherein the heating element is a water heater element.

11. The scale-inhibiting heating element of claim 7 wherein the heating element comprises an electrical wire, an electrically insulating layer surrounding the electrical wire, and a sheath surrounding the electrically insulating layer.

12. The scale-inhibiting heating element of claim 11 wherein the sheath comprises a corrosion resistant metal.

13. A method of manufacturing a scale-inhibiting heating element, the method comprising applying a diamond-like coating to the surface of the heating element.

14. A water heater comprising:

a tank for containing water; and a heating element having a diamond-like coating disposed on the surface of the heating element.

15. A method of minimizing galvanic corrosion of a metal in contact with water which contains an electric heating element immersed therein, the method comprising applying a diamond-like coating to the surface of the heating element.

16. The method of claim 15 wherein the metal is a water heater tank.

17. The method of claim 15 wherein the metal is an anode.

18. The method of claim 15 wherein the electric heating element is a water heater element.

19. The method of claim 15 wherein an interfacial layer is applied to the surface of the heating element prior to applying the diamond-like coating.

20. The method of claim 19 wherein the interfacial layer comprises an amorphous silicon.

21. The method of claim 15 wherein the water is unpurified water.

22. A method of operating an electric water heater, the water heater including a metal water tank and a metal water heating element extending into the tank, the method comprising:

bonding a diamond-like coating to the surface of the heating element to inhibit scaling of the heating element and to minimize galvanic corrosion of either the tank or the heating element when the tank is filled with water;

filling the tank at least partially with unpurified water; and heating the unpurified water with the heating element.

* * * * *